United States Patent [19]

Burgess et al.

[11] 3,966,041

[45] June 29, 1976

[54] SAFETY MATCHBOOK

[76] Inventors: John Burgess, 1336 N. Occidental Blvd., Los Angeles, Calif. 90026; Don Byrd, 1429 Greenwood Ave., Montebello, Calif. 90640

[22] Filed: Jan. 27, 1975

[21] Appl. No.: 544,206

[52] U.S. Cl. ..... 206/108

[51] Int. Cl.[2] ..... A24F 27/18; A24F 27/00; A24F 27/12

[58] Field of Search ..... 206/108, 109, 111, 115, 206/106, 113

[56] References Cited

UNITED STATES PATENTS

| | | | |
|---|---|---|---|
| 2,217,854 | 10/1940 | Baldwin | 206/109 |
| 2,935,184 | 5/1960 | Olson | 206/109 |

*Primary Examiner*—William T. Dixson, Jr.
*Attorney, Agent, or Firm*—Blakely, Sokoloff, Taylor & Zafman

[57] ABSTRACT

A safety matchbook comprises a cardboard blank folded so as to form a matchbook, retains a plurality of matches and has a striking surface within a chamber for igniting a match. The striking surface is concealed within a tubular chamber formed by the folds of the cardboard blank and is accessible through a hole in a side of the chamber. The match, which is bent or scored at a point immediately below its head, is ignited by inserting the end of the match opposite the head into the hole so that the opposite end extends through one end of the tubular chamber. The match is then pulled through the chamber, thereby drawing the head of the match across the striking surface, igniting the match.

7 Claims, 5 Drawing Figures

SAFETY MATCHBOOK

BACKGROUND OF THE INVENTION

The present invention relates to a safety extremely having a novel striking surface, particularly one which is extemely difficult for operation by children. It is well known that matchbooks containing unused matches are frequently left in households and other areas where they are readily accessible to young children. The striking surface of the conventional matchbook is generally located on an outside portion of the cardboard cover. Young children have the motor coordination to ignite the matches by striking them across the exposed striking surface. It is desirable that means be provided for preventing young children from intentionally or accidentally igniting matches for obvious reasons.

In the past various safety matchbooks have been proposed in which the striking surface is made less susceptible to use by young children. For example, in U.S. Pat. No. 2,935,184 issued to K. E. Olson, the cardboard blank is folded so as to provide a tubular chamber having a striking surface along the inside of the chamber. The match head is partially inserted into either end of the chamber, pressure applied to the outside of the chamber and the match withdrawn, thereby igniting the match. The chamber of Olson need not be deformed in any manner in order to receive the match. The size of the chamber, being larger than the width of the match head prior to insertion, aside from allowing easy lighting of the match, allows oxygen to be available in the chamber during the striking operation. This may cause flare ups or ignition of the match within the chamber, possibly igniting the entire matchbook.

In the present invention, a hole is formed in one side of a chamber. The striking surface is within the chamber. The end of the match opposite the head is inserted within the hole until the end extends outside one end of the chamber. The match is bent below the head so that if it is attempted to insert the match head within the hole in the side of the chamber the match will bend.

In an alternate embodiment a chamber is formed by appropriately folding the matchbook blank. The striking surface is contained within the chamber and the match head is inserted at one end of the chamber. Prior to insertion of the match head within the chamber, however, it is necessary first to deform the shape of the chamber so as to permit the match head to fit within it. In the preferred embodiment the chamber is generally oval and the ends of the chamber must be pressed together to impart a generally circular shape to the chamber prior to the insertion of the match head. The match immediately below the head is weakened by scoring or bending slightly so that if the match head is attempted to be forced into the chamber prior to the chamber being deformed, the portion of the match above the weakened portion will bend the match preventing its subsequent insertion in the chamber.

The foregoing will become more clearly apparent from the following description of the invention when taken in conjunction with the accompanying drawings.

BRIEF DESCRIPTION OF THE DRAWINGS

Referring to the drawings.

DETAILED DESCRIPTION OF THE DRAWINGS

Figure 1:
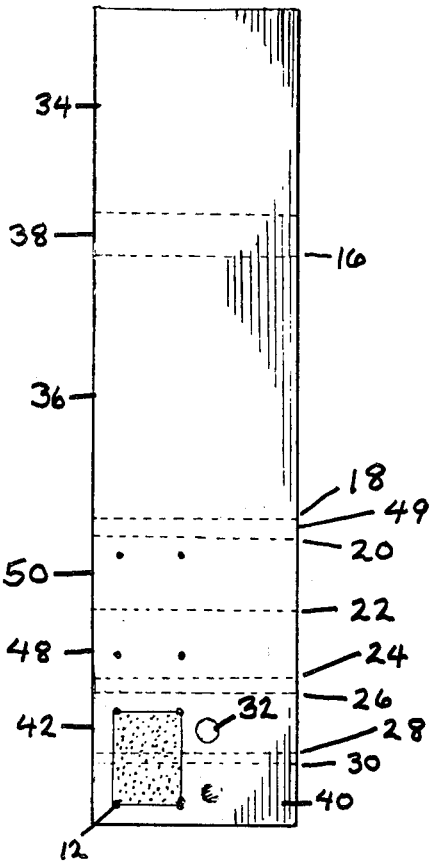
FIG. 1 is a plan view of the safety matchbook blank prior to folding.

Referring to FIG. 1 the blank for the safety matchbook 10 prior to folding is shown with a striking surface 12 mounted at one end thereof. Appropriate score lines 14 through 30 assist in folding the blank into the desired shape. A hole 32 is centrally positioned in the lower end of the blank, the hole having a diameter slightly larger than the width of a match head. As illustrated, the striking surface 12 is positioned to one side of the hole 32. It is recognized that either an additional striking surface could be placed on the other side of the hole 32 or that the entire bottom surface could be covered by a striking surface 12.

The matchbook is formed by folding front cover 34 along score lines 14 and 16 until front cover 34 is parallel to back cover 36. The portion between score lines 14 and 16 of the blank forms a top 38. The blank is then folded along score lines 6 and 8 so that the bottom portion of the blank is also substantially parallel to and between the front and back covers 34 and 36. The blank is then folded along score line 22 in a direction toward the back cover so that score lines 24 and 26 are brought substantially into contact with the bottom segment 49 of the blank located between score lines 18 and 20. The blank is then folded along score lines 24 and 26 in a direction away from the back cover 36. The bottom panel 40 containing a portion of the striking surface is folded over along score lines 28 and 30 so that the remaining portion of the striking surface material on panel 42 is brought adjacent to the striking surface on panel 40.

A pad of matches in which a plurality of individual matches 44, ordinarily 20 in number, is mounted on support bases 46 and is inserted in the matchbook between the surface of the bottom panel 40 opposite that containing the striking material and panel 48 between score lines 22 and 24. A staple 50 is then driven through panels 40, 42, the match support bases 46, and panels 48 and 50. The cover 34 of the matchbook may be fitted between the match support base 36 and panel 48 so as to close the matchbook. The staple 50 is preferrably positioned below the hole 32 so as to not interfere with a match being inserted in either side of the chamber 54 formed between panels 40 and 42.

The matches 44 have a match head 52 of ignitable material at an end opposite to the end of the match removeably connected to the match support base 46. Immediately below the match head the matches, which are made of paper, are weakened 53, such as by scoring or bending, thereby imparting a structural weakness to the match at that point.

The chamber 54 has a non-circular cross-section smaller than the width of the match head 52. Should it be attempted to insert a match head 52 into either the opening 32 or the ends 56 or 58 of the chamber, it will result in the deformation of the match at the weakened point 53 of scoring or bending of the match rather than permitting the match head to enter the chamber 54.

Figure 4:
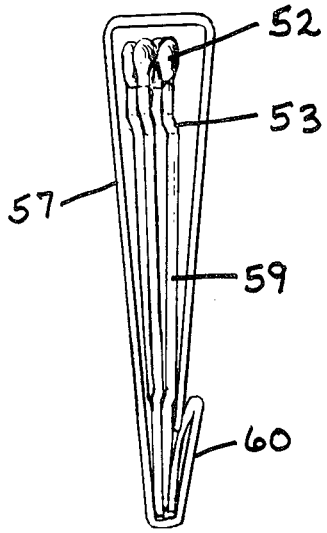
FIG. 4 is a side view of a second embodiment of the invention prior to deformation of the striking chamber.
Figure 5:
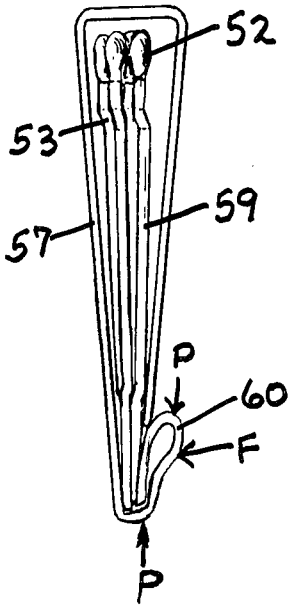
FIG. 5 is a side view of the safety matchbook of FIG. 4 with the striking chamber deformed.

Referring to FIGS. 4 and 5 a second embodiment is disclosed which does not employ an aperture or hole 32 on the side of the chamber. In FIG. 4 a match cover 57 covering matches 59 has a chamber 60 as shown in FIG. 4. The chamber 60 has a cross sectional area smaller than the the width of a match head. Again, should a match be attempted to be inserted within chamber 60, as shown in FIG. 4, the match will bend at score line 53 rather than enter the chamber 60. In FIG. 5 the chamber 60 is illustrated as being deformed following pressure P being applied to the striking chamber 60, in the direction shown by arrows P. Such pressure P deforms the striking chamber 60 into a generally circular cross sectional area, or oval having a section larger than the width of a match head 52 so that the match head 52 may now be readily inserted within the striking chamber.

It is recognized that the illustrated blanks are only preferred embodiments of the present invention and the position of the chambers can be varied by folding appropriate blanks differently. The striking chamber may be located on the outside of the matchbook or on the inside without departing from the scope of the present invention.

OPERATION OF THE DEVICE

Figure 2:
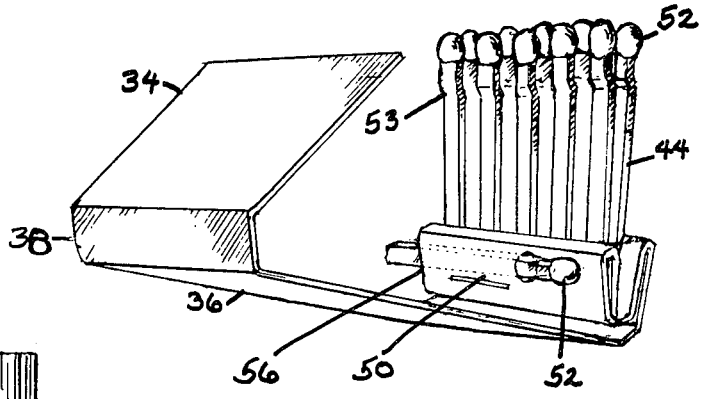
FIG. 2 is a perspective view of the safety matchbook with a match inserted in the hole ready for striking.
Figure 3:
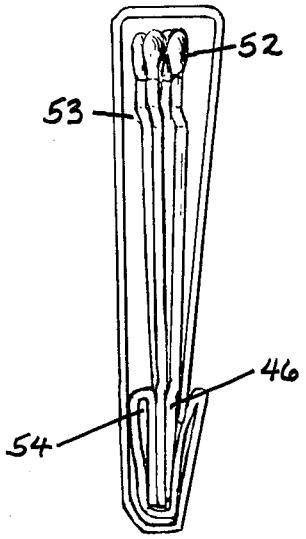
FIG. 3 is a side view of the safety matchbook of FIG. 2.

Referring to FIGS. 1 through 3, in the operation of the present invention, a match 44 is broken away from the match support base 46. The end of the match opposite the head 52 is inserted in a direction generally parallel to the surface of the matchbook through aperture 32 until such end of the match extends through either end 56 or 58 of the striking chamber such as shown in FIG. 2. The end of the match opposite the match head 52 is then rapidly pulled away in the direction of insertion of pulling the match head through opening 32 and against the striking surface 12 within the striking chamber 54, thereby igniting the match. Should it be attempted to insert the match head 52 in either the hole 32 or either end 56 or 58 of the striking chamber 54, the match 44 will bend along the weakened portion 53 rather than enter the chamber. This process makes it very difficult for young children to ignite a match.

The use of a striking chamber having a reduced cross sectional area reduces the possibility of a flare up or ignition of the match head while it is still within the striking chamber 54. This is due to the limited amount of oxygen which is available within the chamber.

In the second embodiment illustrated in FIGS. 4 and 5 the match is ignited by first detaching a match 44 from the match support base 46. The striking chamber 60 is then grasped between the thumb and fore finger and pressure applied, as shown in FIG. 5, to the top and bottom of the striking chamber 60 thereby deforming the striking chamber 60 from its initial configuration to a generally oval or circular cross section. After the chamber 60 has been sufficiently deformed so as to permit a match head to fit within the striking chamber 60 the match head is inserted until a small portion of the match remains outside of the striking chamber 60.

Force may then be applied on the striking chamber as illustrated in FIG. 5, thereby transmitting additional pressure on the match head, as shown by arrow F, and the match rapidly withdrawn from the striking chamber, thereby igniting the match. Again, should a match be attempted to be inserted within chamber 60 prior to it being deformed, the match will bend along score line 53 rather than be inserted.

We claim:

1. A matchbook comprising a cover; a plurality of matches, said matches being retained by said cover, a striking surface, said striking surface being enclosed within a chamber having at least one open end formed in said cover, and an aperture disposed along one side of said chamber which aperture communicates with the interior of said chamber such that the end of one of said matches opposite the match head may be inserted into said aperture and withdrawn from said open end thereby contacting said match head with said striking surface.

2. The matchbook defined by claim 1 wherein the cross sectional area of said open end is less than the cross sectional area of said match head such that said match head may not be inserted into said chamber through said open end of said chamber.

3. The matchbook defined by claim 2 wherein each of said plurality of matches includes weakened sections to prevent entry of said match head into said open end of said chamber.

4. The matchbook defined by claim 3 wherein said aperture is disposed along the side of said chamber such that said matches must be folded away from said cover to expose said aperture.

5. A matchbook comprising:

a cover;

a plurality of matches, each of said matches having a match head and each of said match heads having a cross sectional area;

a chamber, said chamber being coupled to said cover and including a striking surface interior to said chamber, said chamber including an open end having a nominal cross sectional area less than said cross sectional area of said match head, said chamber being manually deformable such that said cross sectional area of said open end of said chamber may be deformed to allow said match head to be inserted into said chamber;

whereby one of said matches may be inserted into said chamber only when said open end of said chamber is deformed.

6. The matchbook defined by claim 5 wherein said chamber is formed by said cover.

7. The matchbook defined by claim 5 wherein each of said matches included a weakened section to prevent said match head from being forced into said open end of said chamber when said open end comprises said nominal cross section.

* * * * *